United States Patent [19]

Layher

[11] Patent Number: 4,603,756

[45] Date of Patent: Aug. 5, 1986

[54] METAL PIPE SCAFFOLDING

[76] Inventor: Ulrich Layher, Im Lailen 16, D-7129 Güglingen-Eibensbach, Fed. Rep. of Germany

[21] Appl. No.: 633,098

[22] Filed: Jul. 20, 1984

[30] Foreign Application Priority Data

Feb. 29, 1984 [DE] Fed. Rep. of Germany ..... 3407425

[51] Int. Cl.[4] ..... E04G 7/30

[52] U.S. Cl. ..... 182/178; 182/179; 403/49; 29/515; 228/173.4

[58] Field of Search ..... 182/178, 179; 403/49; 29/505, 515, 163.5 R; 228/173.4, 182; 52/636, 637

[56] References Cited

U.S. PATENT DOCUMENTS

| | | | |
|---|---|---|---|
| 3,726,414 | 4/1973 | Konstant | 228/173.4 |
| 4,083,640 | 4/1978 | Lovering | 403/49 |
| 4,290,573 | 9/1981 | Shapiro | 248/174 |
| 4,493,578 | 1/1985 | D'Alessio | 182/178 |

FOREIGN PATENT DOCUMENTS

| | | | |
|---|---|---|---|
| 2449124 | 1/1980 | Fed. Rep. of Germany . | |
| 1474020 | 5/1977 | United Kingdom | 403/49 |

*Primary Examiner*—Reinaldo P. Machado
*Assistant Examiner*—Alvin Chin-Shue
*Attorney, Agent, or Firm*—Michael J. Striker

[57] ABSTRACT

In a scaffolding system in which vertical metal scaffold pipes are connected to non-vertical metal scaffold pipes by disc-shaped bridged connecting flanges, each non-vertical scaffold pipe has a wedge-shaped end portion terminated with edges which are curved at the end face of the pipe inwardly of the pipe and form together a smooth supporting surface supported against the outer wall of the adjacent vertical scaffold pipe. Each non-vertical scaffold pipe is provided with a slot in which the disc-shaped connecting flange is engaged in the assembled scaffolding.

9 Claims, 11 Drawing Figures

METAL PIPE SCAFFOLDING

BACKGROUND OF THE INVENTION

The present invention relates to a metal pipe scaffolding in which vertical scaffold elements formed of cylindrical scaffold pipes are connected to non-vertically extended scaffold pipe elements by connected flanges of the shape of a circular disc, provided with bridging and by means of releasable wedges.

Metal pipe scaffolds have been known in the art; one of them has been disclosed in DBP No. 24 49 124. In this metal pipe scaffolds, a connection of non-vertically extended scaffold elements, for example a horizontally arranged longitudinal or transversal locking bar has been obtained by means of connecting shoes which are formed as cast iron pieces separately from the scaffold pipes forming the scaffold elements and connected to the scaffold elements by welding or in any other suitable fashion. Such a construction, however, has certain disadvantages. Time consumption and costs of manufacturing of such known systems have been considerable because due to the differences in materials (malleable cast iron, on the one hand, and low carbon steel, on the other hand) and the occurrence of various metallurgic problems in a welding process, it has been necessary to improve the outer surfaces of the pipes by galvanization. Furthermore, a required control of the malleable cast iron has also involved considerable expenses. Therefore, it caused producing the connecting shoes of cast iron as a complete material, which led, of course, to a substantial increase of weight of the scaffolds.

SUMMARY OF THE INVENTION

It is an object of the present invention to provide an improved metal pipe scaffolding.

It is another object of the invention to provide a pipe scaffolding in which the above discussed disadvantages would be avoided.

These and other objects of the invention are attained by a metal pipe scaffolding, comprising vertical scaffold elements formed of cylindrical scaffold pipes, non-vertically extended scaffold elements locked by wedges, and connecting flanges formed of circular discs and provided with bridges for connecting the vertical scaffold elements to the non-vertically extended scaffold elements, each non-vertically extended scaffold element being formed of a scaffold pipe and having a central plane and including an end portion having wedge-shaped ends, said ends having edges which are slightly curved and together form a vertically extended smooth supporting surface for supporting a wall of the vertical scaffold element being connected to the non-vertically extended scaffold element, said non-vertically extended scaffold element having a front region at said end portion and being formed with at least one slot extended along said central plane and lengthwise of said non-vertically extended scaffold element for engaging therein the connecting flange for connecting the vertical scaffold element, said end portion of the non-vertically extended scaffold element being formed with two diametrically opposite rectangular openings for receiving and guiding the wedges.

It is important that due to the curving of the edges toward each other the formation of sharp edges on the supporting surface is avoided and damage to the wall of the vertical scaffold element is prevented.

The end portion of each non-vertical scaffold element may be formed with diametrically opposite strip-like material portions formed at said rectangular openings for providing guiding surfaces for wedges inserted in said openings.

Each scaffold pipe may have a pipe wall, said strip-like material portions being formed by the material of the pipe wall in the region of each opening, torn off at three sides of each opening and bent off at one smaller fourth side of each opening inwardly of the scaffold pipe.

The strip-like material portions may be formed by the material of the pipe wall in the region of each opening, torn off at two longer sides of each opening, cut in the middle of the opening and bent off at two smaller sides of each opening inwardly of the scaffold pipe.

The strip-like material portions may be curved within the scaffold pipe.

The construction of the connecting arrangement on the nonvertical scaffolding elements according to the invention permits the avoidance of connecting shoes formed of cast iron so that a reliable weld seam is no longer in question and costs as well as weight of scaffolding can be reduced The curved edges forming the supporting surface may be welded to each other.

The supporting surface may be concave and may be described by a radius which corresponds to an outer radius of the vertical scaffold element.

The slot may have an open end, said end portion at said opening being formed with a recess merging into said open end.

Each of the wedges may have an elongated portion and a projection extended at an angle to said elongated portion, said wedge being provided with means preventing lost of the wedge.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 6:
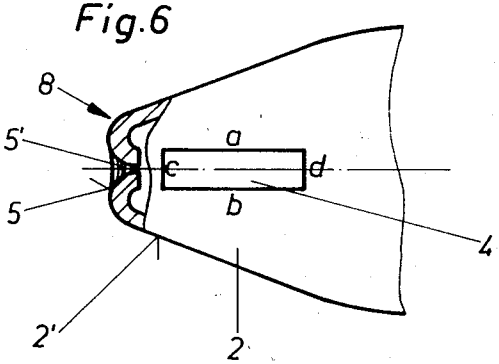
FIG. 6 is a top plan view similar to that of FIG. 3 but with a part in section taken on line VI—VI of FIG. 1.

Referring now to the drawings, and first to FIGS. 1–6, reference numeral 1 designates a scaffolding pipe forming a locking bar. The end portions of the horizontal or non-vertically extended scaffolding pipe 1 are formed by a pressing process. These end portions designated by reference characters 2 are wedge-shaped or sloped. Lateral flanks 2' of these wedge-shaped end portions 2 extend vertically. The end edges of lateral flanks 2' extend in the horizontal cross-section toward each other and are also curved inwardly so as to form rounded edges 8 as shown in FIG. 6. This curving is made in such a manner that the rounded edges 8 in the vertical direction are parallel to each other. Opposite edges 8 are connected to each other by a weld seam 5' and together form in the vertical direction a straight line surface 5 which serves the purpose of supporting an outer surface of the vertical scaffold element adjacent in the scaffolding to the horizontal scaffolding pipe 1 discussed herein. The total length of the double edge 5, owing to the spreading of the end of scaffolding pipe during the pressing process, is about from 1.5 to 1.57 of the outer diameter of the pipe.

In the region of the front end of the wedge-shaped end portion 2 of the scaffolding pipe 1 are formed elongated recesses or slots 3. Two slots 3 formed in the wall of pipe 1 are diametrically opposite to each other and extend lengthwise of the horizontal central plane of the pipe 1. The width of recess 3 is such that the connection flange of the vertical scaffold element can be engaged in both slots 3. To ensure a satisfactory support of the surface 5 for the pipe wall of the vertical scaffold element surface 5 is concavely curved in the horizontal direction as seen in FIG. 6. The radius of curving of supporting surface 5 corresponds to the outer radius of the pipe of the vertical scaffold element. In order to facilitate guiding of the connecting flange into the slots 3 an enlarged recess 6 is provided at the open ends of slots 3, which recess ensures that unevennesses, which can occur on the weld seam between the pipe wall of the vertical scaffold element and the connecting flange, would be bridged and an unobjectionable support of the edge surface 5 against the wall of the vertical scaffold element would be ensured.

Figure 8:
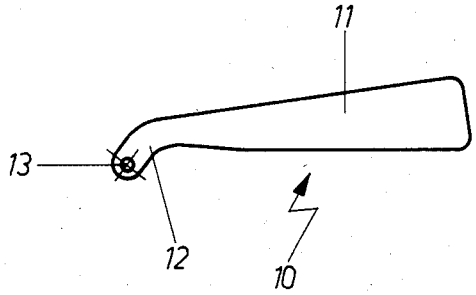
FIG. 8 is a side view of the wedge.

Each horizontal scaffold pipe element 1 is provided with two diametrically opposite substantially rectangular openings 4 formed in the pipe wall of element 1 for receiving and guiding wedges to which the scaffold element is fastened. Such a wedge is shown in FIG. 8 and denoted by a reference character 10. Openings 4 lie in the vertical direction opposite each other. The central lines or axes of these openings extend in the vertical central plane of the scaffolding pipe 1. The dimensions of the openings and their respective distance from the supporting surface 5 are so selected that during the wedging into the openings of the connecting flange the support surface 5 is pressed, due to a wedging action, with a required pressure against the outer surface of the vertical scaffold element.

Figure 1:
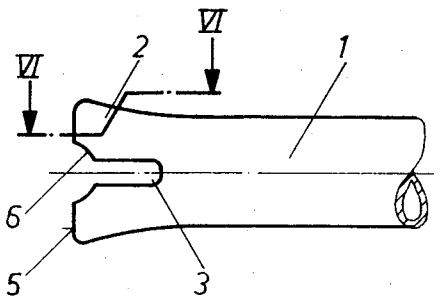
FIG. 1 is a side view of the end portion of the horizontally extended scaffold element.
Figure 3:
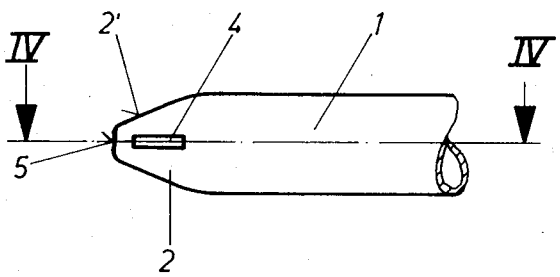
FIG. 3 is a top plan view of the scaffold element of FIGS. 1 and 2.
Figure 4:
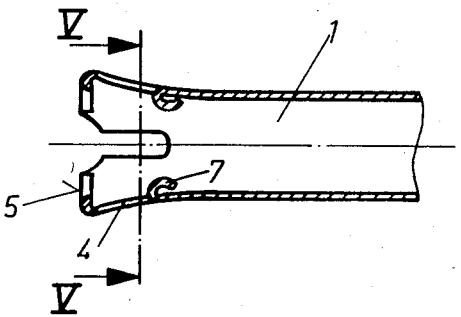
FIG. 4 is a sectional view taken along line IV—IV of FIG. 3.
Figure 2:
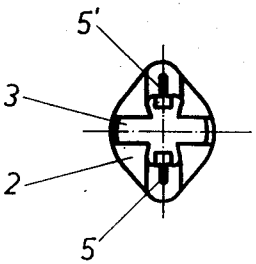
FIG. 2 is a front view of the scaffold element seen from arrow 11 of FIG. 3.
Figure 5:
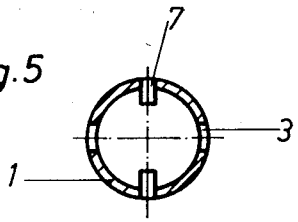
FIG. 5 is a sectional view taken on line V—V of FIG. 4.

As can be seen from FIG. 6, to provide for a reliable supporting surface for the wedge it is expedient during the formation of rectangular openings 4 not to separate the material of the pipe wall within the opening 4 from all the sides of each opening 4 but to only separate that material, for example at three sides a, b, and c of the opening so as to form a suspended material strip attached to the pipe wall at the smaller side d of the opening. Thereby two diametrically opposite material strips 7 can be formed which are bent inwardly of the scaffold pipe 1 as shown in FIG. 4. These bent or inwardly curved material strips 7 are further deformed in a roll-like fashion so that they form in both openings 4 reinforced edges of the openings on the one hand, and satisfactory supports for the wedges 10 inserted into openings 4 as seen in FIG. 9.

Figure 7:
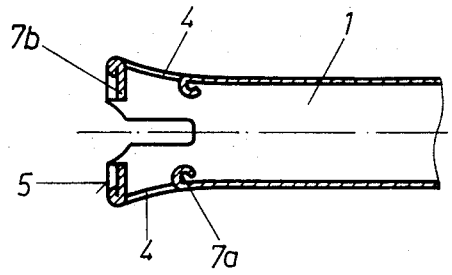
FIG. 7 is a sectional axial view through the scaffold element according to another embodiment of the invention.

Instead of tearing off the material at three sides a, b and c in order to produce a strip 7 at side d of each opening 4 it is also possible to form material strips at two opposite smaller sides c and d of each opening 4. For this purpose the material of the pipe wall is not torn off at smaller sides c and d and is only separated from the pipe wall at the longer sides a and b in the direction of elongation of the scaffold pipe 1; then a cut is produced approximately in the middle of the material covering opening 4 between the smaller sides c and d and thereafter material strips **7*a* and 7*b*, as shown in FIG. 7, are formed, which strips are bent inwardly of the pipe. Material strips 7*b* at the front end of the pipe and at side c extend approximately perpendicularly to the central axis of the pipe whereas material strips 7*a* at the smaller opposite side d of opening 4 are deformed or curved in the roll-shaped manner. Thereby both smaller sides of each opening 4 are reinforced and at the same time sufficient support surfaces are formed for supporting and guiding wedges inserted into openings 4. The advantage of this construction is that both smaller sides c and d of each opening 4** having no sharp edges so that abrasion during the driving of the wedge into the opening would be avoided.

Advantageously the wedge 10 is formed so that it can not be lost once it was fastened with the end of the scaffold element. For this purpose the narrower end of the wedge is provided with a blind rivet 13. The shape of the wedge in this invention is so adjusted that its end projection 12 is bent off in the downward direction. An elongated portion 11 of wedge 10, which provides for a wedge action, is integral with the abutment or projection 12 which carries the above mentioned rivet 13. Wedge 10 is inserted into the end portion of the scaffold pipe 1, the width of the upper opening **4*a* can be so selected that passing of the blind rivet therethrough is impossible while the width of the lower opening 4*b* can be larger to allow the end of the wedge 10 with the blind rivet 13 to pass therethrough. Projection 12 should be so dimensioned that the wedge could be pulled out from the scaffold pipe so that the insertion of the connecting flange into slots 3 would not be hindered. A particular advantage of the wedge shape described herein resides in that the wedge can be readily inserted into and pulled out from the opening 4 without hindering the connection of the vertical scaffold elements to the horizontal scaffold pipes 1 and that the elongated portion 11 during the pulling of the wedge out from pipe 1** immediately lies on the scaffold pipe.

Figure 9:
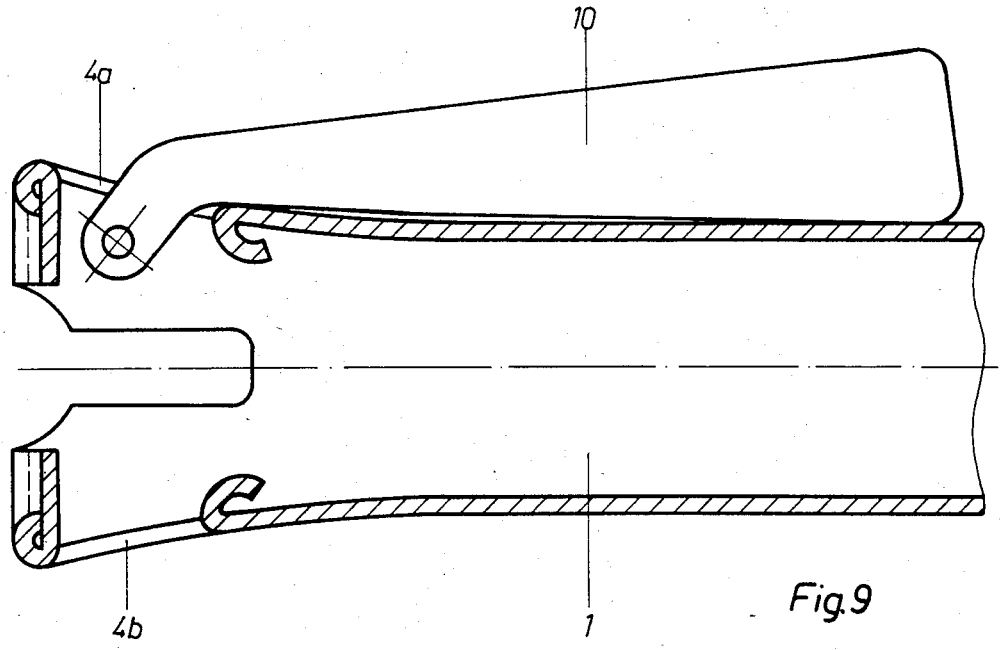
FIG. 9 is a view similar to that of FIG. 7 but with the inserted wedge and on an enlarged scale.
Figure 10:
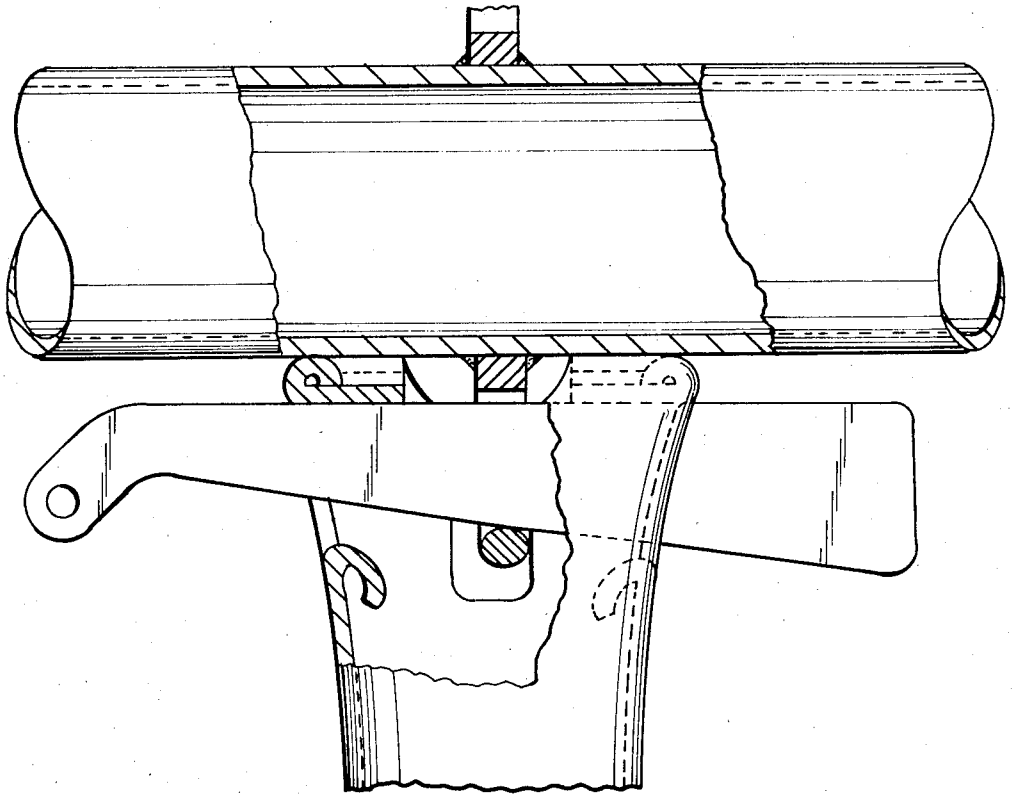
FIG. 10 is partial sectional view of the scaffolding including a vertical tubular element, a flange welded thereto and a horizontal scaffold element with the wedge.
Figure 11:
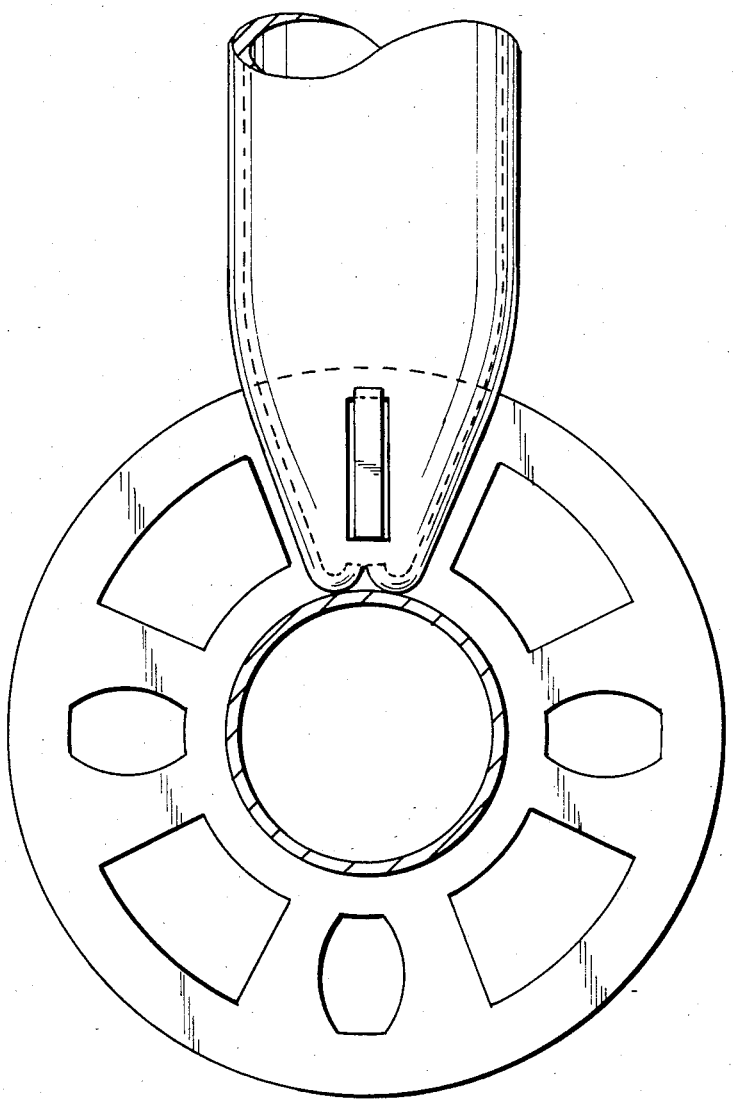
FIG. 11 is a view from above of FIG. 10 and offset by 90°.

FIGS. 10 and 11 show an assembly of the vertical scaffold element with a flange secured thereto and receiving a wedge inserted into the horizontal scaffold element shown in FIG. 9.

It will be understood that each of the elements described above, or two or more together, may also find a useful application in other types of metal pipe scaffoldings differing from the types described above.

While the invention has been illustrated and described as embodied in a metal pipe scaffolding, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In a metal pipe scaffolding including vertical scaffold elements formed of cylindrical scaffold pipes locked by wedges, non-vertically extending scaffold elements, and connecting flanges formed of circular discs and provided with bridges for connecting the vertical scaffold elements to non-vertically extended scaffold elements, each non-vertically extending scaffold element being formed of a scaffold pipe by pressing process and having a central plane and including an end portion having deformed wedge-shaped ends which together form a vertically extended straight and smooth supporting surface for supporting a wall of the vertical scaffold element being connected to the non-vertically extended scaffold element, said non-vertically extended scaffold element having a front region at said end portion and being formed with at least one slot extended along said central plane and lengthwise of said non-vertically extended scaffold element for engaging therein one of said connecting flanges for connecting the vertical scaffold element, said end portion of the non-vertically extended scaffold element being formed with two diametrically opposite openings for receiving and guiding a respective wedge, said ends being curved inwardly of the non-vertically extended scaffold element and forming deformed rolled-in portions which are connected to each other by a vertical weld seam, said rolled-in portions defining said supporting surface in a horizontal direction as a concavely curved surface which has a radius which corresponds to an outer radius of the pipe of the vertical scaffold element.

2. The scaffolding as defined in claim 1, wherein a total length of said end portion is about from 1.5 to 1.57 of an outer diameter of the scaffold pipe of said non-vertical scaffold element.

3. The scaffolding as defined in claim 1, wherein said slot has an open end, said end portion at said open end being formed with a recess merging into said open end.

4. The scaffolding as defined in claim 1, wherein each of said wedges has an elongated portion and a projection extended at an angle to said elongated portion, said wedge being provided with means preventing losing of the wedge.

5. The scaffolding as defined in claim 1, wherein said end portion is formed with diametrically opposite strip-like material portions formed at said openings for providing guiding surfaces for wedges inserted in said openings, said openings being of rectangular shape.

6. The scaffolding as defined in claim 5, wherein each scaffold pipe has a pipe wall, said strip-like material portions being formed by the material of the pipe wall in the region of each opening, torn off at three sides of each opening and bent off at one smaller fourth side of each opening inwardly of the scaffold pipe.

7. The scaffolding as defined in claim 6, wherein said strip-like material portions are curved within the scaffold pipe.

8. The scaffolding as defined in claim 5, wherein each scaffold pipe has a pipe wall, said strip-like material portions being formed by the material of the pipe wall in the region of each opening, torn off at two longer sides of each opening, cut in the middle of the opening and bent off at two smaller sides of each opening inwardly of the scaffold pipe.

9. The scaffolding as defined in claim 8, wherein at least two diametrically opposite strip-like material portions are curved within the scaffold pipe.

* * * * *